US010354848B2

(12) United States Patent
Moulds

(10) Patent No.: US 10,354,848 B2
(45) Date of Patent: Jul. 16, 2019

(54) METHOD OF MASS ANALYSIS USING ION FILTERING

(71) Applicant: MICROMASS UK LIMITED, Wilmslow Cheshire (GB)

(72) Inventor: Richard Moulds, Stockport (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/576,980

(22) PCT Filed: May 31, 2016

(86) PCT No.: PCT/GB2016/051579
§ 371 (c)(1),
(2) Date: Nov. 27, 2017

(87) PCT Pub. No.: WO2016/193699
PCT Pub. Date: Dec. 8, 2016

(65) Prior Publication Data

US 2018/0166262 A1 Jun. 14, 2018

(30) Foreign Application Priority Data

May 29, 2015 (GB) ..... 1509244.8

(51) Int. Cl.
*H01J 49/00* (2006.01)
*H01J 49/06* (2006.01)
(Continued)

(52) U.S. Cl.
CPC ..... *H01J 49/0031* (2013.01); *H01J 49/061* (2013.01); *H01J 49/36* (2013.01); *H01J 49/421* (2013.01); *H01J 49/4215* (2013.01)

(58) Field of Classification Search
CPC .... H01J 49/0027; H01J 49/0031; H01J 49/06; H01J 49/36; H01J 49/42; H01J 49/421; H01J 49/4215; H01J 49/061
See application file for complete search history.

(56) References Cited

U.S. PATENT DOCUMENTS 5,422,482 A 6/1995 Nakajima
8,791,408 B2 * 7/2014 Bowdler ..... H01J 49/0036 250/282

(Continued)

FOREIGN PATENT DOCUMENTS

EP 2557590 A1 2/2013

OTHER PUBLICATIONS

International Search Report and Written Opinion for International Application No. PCT/GB2016/051579, issued Aug. 16, 2016 and dated Aug. 24, 2016.

*Primary Examiner* — David E Smith
(74) *Attorney, Agent, or Firm* — Womble Bond Dickinson (US) LLP; Deborah M. Vernon; Heath T. Misley

(57) ABSTRACT

A method of mass spectrometry is disclosed comprising detecting the ions transmitted by a mass filter (4) with a detector (6); changing the RF and/or DC voltage applied to the mass filter (4) during a voltage transition period so as to change the mass to charge ratio capable of being transmitted by the mass filter (4); preventing ions from reaching the detector during the voltage transition period; and allowing ions to be transmitted to the detector (6) after the voltage transition period.

10 Claims, 4 Drawing Sheets

(51) Int. Cl.
*H01J 49/42* (2006.01)
*H01J 49/36* (2006.01)

(56) References Cited

U.S. PATENT DOCUMENTS

| | | | | |
|---|---|---|---|---|
| 2007/0090287 | A1 | 4/2007 | Foote | |
| 2009/0266983 | A1* | 10/2009 | Yamamoto | H01J 49/0036 250/287 |
| 2010/0084552 | A1* | 4/2010 | Kawana | H01J 49/0077 250/288 |
| 2013/0018621 | A1* | 1/2013 | Telasang | H01J 49/0036 702/104 |

* cited by examiner

METHOD OF MASS ANALYSIS USING ION FILTERING

CROSS-REFERENCE TO RELATED APPLICATION

This application is a National Stage Application of International Application No. PCT/GB2016/051579 filed May 31, 2016, which claims benefit of and priority to United Kingdom patent Application No. 1509244.8 filed May 29, 2015. The entire contents of each of which are incorporated herein by reference.

FIELD OF THE INVENTION

The present invention relates generally to mass spectrometers and in particular to a mass spectrometer that analyses ions by detecting the ions transmitted by a mass filter.

BACKGROUND

It is known to use quadrupole rod sets to filter ions according to their mass to charge ratio. Different combinations of RF and DC voltages may be used to select the mass to charge ratios that are transmitted by the quadrupole. The RF and DC voltages are typically fixed for a first period such that the quadrupole selectively transmits only ions having a first mass to charge ratio of interest. The RF and DC voltages are then stepped such that in a second period the quadrupole selectively transmits only ions having a second mass to charge ratio of interest. Such methods may be used, for example, to select ions in single ion recording (SIR), single reaction monitoring (SRM) and multiple reaction monitoring (MRM) experiments.

When a quadrupole is used in this manner the ion current that is transmitted during the first period may be very large, whereas the ion current transmitted during the second period may be relatively small. The first, large ion current can cause the detector baseline to shift. For example, if a photomultiplier is used as the detector, a large ion signal can cause the photo-cathode of the detector to become excited and emit electrons for a significant period of time after the stimulus has been removed. Such baseline shifts can cause measurement errors for the channel(s) that follow the high intensity channel.

It is known to measure the detector's baseline level prior to an analytical acquisition. The baseline level can then be subtracted from ion signals measured during the analytical run. However, such methods are unable to take into account shifts in the baseline level that can occur after a high ion current has been detected.

Many quadrupole voltage driving circuit designs cause the DC voltage component to lag the RF voltage component. When the quadrupole is stepped so that the mass to charge ratios of the ions that are transmitted increases with time, the DC voltage component is temporarily lower than the RF voltage component . This temporarily allows ions having a wide range of mass to charge ratios to be transmitted by the quadrupole. Other voltage driving circuit designs cause the DC voltage component to lead the RF voltage component. When the quadrupole is stepped so that the mass to charge ratios of the ions that are transmitted decreases with time, the quadrupole may de-resolve. Again, this results in a relatively large pulse of ions being temporarily transmitted by the quadrupole. The amplitude of the ion pulse depends upon the number of ion species near to the analytes being measured and to their abundancy. It will therefore be appreciated that the stepped operation of a quadrupole may sometimes result in relatively large pulses of ions impinging on the downstream devices, such as an analytical mass filter or detector, each time that the quadrupole is stepped. If relatively large pulses of ions arrive at such a downstream device it can have deleterious results.

Mass spectrometers employing quadrupole mass filters typically gather data only when the quadrupole filtering action is at steady state, i.e. when the RF:DC ratio is substantially fixed. For example, if analytes A and B are to be analysed, the system will change the required RF and DC voltage components so as to filter all ions except those having a mass to charge ratio corresponding to that of analyte A, will then wait for the voltages on the electrodes of the quadrupole to settle so as to facilitate suitable mass resolution, and will then measure and record the ion current for a period of time. The system will then stop recording the ion current before programming the next RF and DC values for analyte B, and will wait for the voltages on the electrodes of the quadrupole to settle prior to recording the ion current for analyte B. The ion currents are then stored in separate channels so as to allow for further data processing. Consequently, the ion current is not recorded or displayed whilst the RF and DC voltages are unstable (i.e. between step values) as this data is not analytically useful.

Thus the deleterious nature of the ion pulses caused by temporary quadrupole de-resolution goes unseen. However, their potential effect on data quality is real, causing shifts in the detector baseline which extend into the scan or dwell period where ions currents are measured and hence may cause mis-quantitation of analytes.

It is desired to provide an improved mass spectrometer and an improved method of mass spectrometry.

SUMMARY

From a first aspect the present invention provides a method of mass spectrometry comprising:

applying RF and DC voltages to electrodes of a mass filter such that the mass filter is capable of substantially only transmitting ions having a selected mass to charge ratio, or a selected range of mass to charge ratios;

detecting the ions transmitted by the mass filter with a detector;

changing the RF and/or DC voltage applied to said electrodes during a voltage transition period so as to change said selected mass to charge ratio, or said selected range of mass to charge ratios, that the mass filter is capable of transmitting;

preventing all ions from reaching the detector during the voltage transition period; and allowing ions to be transmitted by the mass filter to the detector after the voltage transition period.

The inventor has recognised that the momentary reduction in the resolving power of the mass filter during the voltage transition period may cause a resulting increase in the ion flux to the detector that affects the detector baseline signal for a period of time that may extend after the voltage transition period has ended. By preventing substantially all ions from being detected during the voltage transition period, the detector baseline signal is preserved during the switching of the mass filter from transmitting one mass to charge ratio to another.

EP 2557590 (Shimadzu) discloses an instrument having a quadrupole mass filter that selectively transmits ions of a specific mass to charge ratio to a detector. The RF and DC voltages applied to the mass filter may be altered so as to select a different mass to charge ratio to be passed to the detector. Shimadzu recognises that when the RF and DC voltages applied to the electrodes of the mass filter are changed at different rates, a large range of mass to charge ratios is transmitted by the quadrupole structure and that this damages the detector. Shimadzu therefore employs a quadrupole upstream and/or downstream of the mass filter for deflecting some of the ions such that they cannot reach the detector whilst the RF and DC voltages on the mass filter are varied. More specifically, the electrodes of the mass filter are connected to the upstream and/or downstream quadrupole via a CR differentiator such that when the voltages applied to the electrodes of the mass filter are varied, the CR differentiator applies a DC voltage to the upstream and/or downstream quadrupole. This causes the upstream and/or downstream quadrupole to deflect the flight paths of ions of low mass to charge ratio such that fewer ions reach the detector during the voltage transition period, and hence damage to the detector is prevented.

However, although the technique of Shimadzu reduces the ion flux to the ion detector during the voltage transition period, it does not prevent all ions from reaching the detector during the voltage transition period. This is because Shimadzu is not concerned with maintaining the baseline level of the detector signal during the voltage transition period, but is instead concerned with preventing damage to the detector caused by very high ion fluxes.

According to the embodiments of the invention, ions are transmitted towards the mass filter and enter the mass filter. Only ions of a first mass to charge ratio, or first range of mass to charge ratios, are transmitted by the mass filter to the detector, whereas other ions are filtered out by the mass filter. The RF and/or DC voltage applied to the electrodes of the mass filter is then varied during the voltage transmission period so as to change the mass to charge ratio, or range of mass to charge ratios transmitted by the mass filter at the end of the voltage transmission period. Substantially all ions are prevented from reaching the detector during this voltage transition period. After the voltage transition period, ions of a second mass to charge ratio, or second range of mass to charge ratios, are transmitted by the mass filter to the detector, whereas other ions are filtered out by the mass filter. The second mass to charge ratio, or second range of mass to charge ratios, is different to the first mass to charge ratio, or first range of mass to charge ratios.

It is contemplated that the RF and/or DC voltage applied to the electrodes of the mass filter may be changed during one or more further voltage transition periods so as to change said selected mass to charge ratio, or said selected range of mass to charge ratios, that the mass filter is capable of transmitting. For example, the voltage(s) may be changed in a second voltage transition period such that at the end of that period the mass filter is only capable of transmitting a third mass to charge ratio, or third range of mass to charge ratios, whereas other ions are filtered out by the mass filter. The third mass to charge ratio, or third range of mass to charge ratios, may be different to the first and second mass to charge ratios, or first and second ranges of mass to charge ratios. Substantially all ions may be prevented from reaching the detector during the second voltage transition period, but may then subsequently be transmitted to the detector.

The method steps disclosed above and/or elsewhere herein may be performed in a single experimental run.

The method may comprise measuring the signal output from the detector during said voltage transition period, when ions are prevented from reaching the detector, so as to determine the baseline signal of the detector; measuring the ion signal from the detector after the voltage transition period, when ions are allowed to be transmitted to the detector; and subtracting said baseline signal from the measured ion signal.

The method may comprise changing the RF and/or DC voltage applied to said electrodes during a further voltage transition period so as to change said selected mass to charge ratio, or said selected range of mass to charge ratios, that the mass filter is capable of transmitting; preventing all ions from reaching the detector during the further voltage transition period; and allowing ions to be transmitted by the mass filter to the detector after the further voltage transition period.

The method may comprise measuring the signal output from the detector during said further voltage transition period, when ions are prevented from reaching the detector, to determine an updated baseline signal for the detector; measuring the ion signal from the detector after the further voltage transition period, when ions are allowed to be transmitted to the detector; and subtracting said updated baseline signal from the measured ion signal.

Although only two voltage transition periods have been described, further voltage transition periods may be provided whilst the RF and/or DC voltages applied to the mass filter are changed. The detector baseline signal may be measured in each of these voltage transition periods and subtracted from subsequently obtained ion signals from the detector.

The method described herein may be used in SIR or MRM experiments, or when a quadrupole scan has completed and is then programmed to return (i.e. step) the voltages to start values. Accurate detector baseline measurements may be made between individual SIR or MRM experiments, channels or scans. Preventing at least some of the ions transmitted by the mass filter from reaching the detector or being detected at the detector as the voltages are changed, between the different experiments, channels or scans, prevents large ion current pulses hitting the detector.

After each of said voltage transition periods all of the ions transmitted by the mass filter may be permitted to reach the detector again.

The mass filter described herein may be a multipole mass filter comprising a multipole electrode rod set. The multipole mass filter may be a quadrupole mass filter comprising a quadrupole rod set. However, other multipoles are contemplated herein. Other configurations and types of mass filters are also contemplated herein, wherein RF and/or DC voltages applied to the mass filter are changed with time so as to transmit ions of different mass to charge ratios.

The step of preventing all ions from reaching the detector during the voltage transition period may comprise: preventing all ions entering the mass filter; and/or preventing all ions transmitted out of the mass filter from reaching the detector.

The step of preventing all ions from reaching the detector during the voltage transition period may comprise applying one or more voltage to at least one electrode of an ion blocking or deflecting device so as to arrange an electrical potential barrier in the path of the ions or so as to deflect the ions such that the ions are prevented from reaching the detector. For example, an ion gate may be used to block the ion path to the detector during the voltage transition period. Alternatively, or additionally, the potential on an Einzel lens or other ion-optical element may be changed so as to form a potential barrier that blocks the ions.

The step of deflecting ions may comprise redirecting the ions or defocussing the ion beam during the voltage transition period such that ions do not reach the detector. This may be achieved by applying one or more voltages to one or more electrodes during the voltage transition period. For example, a voltage may be applied to an ion steering lens or ion deflector electrode so as to divert the ions such that they do not reach the detector.

Ions may be deflected so as to impact on a surface that neutralises the ions during the voltage transition period, e.g. onto an electrode.

The voltage applied to the at least one electrode of an ion blocking or deflecting device may be controlled independently of the RF and DC voltages applied to the electrodes of the mass filter. This enables the ion blocking or ion deflecting to be controlled independently of the voltages applied to the mass filter and may hence be more effective. Also, the ion blocking or ion deflecting electrodes may not be electrically coupled to the electrodes of the mass filter and so the ion blocking or ion deflecting voltages may not be transmitted to or affect the mass filter.

The mass filter may be a multipole filter, or a multipole filter may be provided upstream of said mass filter for transmitting ions into the mass filter, or a multipole filter may be provided between said mass filter and said detector for transmitting ions from the mass filter to the detector. An RF and/or DC voltage may be applied to said multipole filter in order to guide ions therethrough, and the RF and/or DC voltage applied to the multipole filter may be changed during the voltage transition period such that no ions are transmitted through the multipole filter.

The method may comprise temporarily increasing the DC voltage applied to the multipole filter during the voltage transition period so as to force all ions to become unstable in the multipole filter.

The mass filter may be said multipole filter, and the step of changing the RF and/or DC voltage applied to the mass filter may comprise changing both the RF and DC voltages applied to said electrodes at said voltage transition period in a manner whereby the DC voltage change leads the RF voltage change so as to prevent all ions reaching the detector.

The step of changing the RF and/or DC voltage applied to said electrodes of the mass filter may comprise discontinuously stepping the value of the RF and/or DC voltage applied to said electrodes.

A first combination of RF and DC voltages may be applied to said electrodes for a first time period during which selected ions having a first mass to charge ratio or first range of mass to charge ratios are transmitted by the mass filter. The RF and/or DC voltage applied to said electrodes may then be changed during the voltage transition period so that a second combination of RF and DC voltages may then be applied to said electrodes for a second time period during which selected ions having a second mass to charge ratio or second range of mass to charge ratios are transmitted by the mass filter.

The RF and/or DC voltage applied to said electrodes may be changed at any number of voltage transition periods.

The step of preventing ions reaching the detector (e.g. being detected at the detector) may be performed for different lengths of time for different voltage transition periods and/or may extend beyond the voltage transition period. For example, the length of time may vary as a function of the time that is expected for the RF and DC voltages to settle to the new values. Alternatively, or additionally, the length of time may vary depending on the direction that the RF and/or DC voltage is stepped (i.e. depending on whether the voltages are changed such that the mass to charge ratio enabled to be transmitted by the mass filter is increased or decreased).

The period during which ions are prevented from reaching the detector or being detected by the detector (e.g. said voltage transition period) for each voltage change may be x, wherein x is selected from the group consisting of: ≥10 μs; ≥20 μs; ≥30 μs; ≥40 μs; ≥50 μs; ≥100 μs; ≥200 μs; ≥300 μs; ≥400 μs; ≥500 μs; ≥600 μs; ≥700 μs; ≥800 μs; ≥900 μs; ≥1 ms; ≥5 ms; ≥10 ms; ≥15 ms; ≥20 ms; ≥25 ms; ≥30 ms; ≥35 ms; ≥40 ms; ≥45 ms; and ≥50 ms. Additionally, or alternatively, x may be selected from the group consisting of: ≤50 ms; ≤45 ms; ≤40 ms; ≤35 ms; ≤30 ms; ≤25 ms; ≤20 ms; ≤15 ms; ≤10 ms; ≤5 ms; ≤900 μs; ≤800 μs; ≤700 μs; ≤600 μs; ≤500 μs; ≤400 μs; ≤300 μs; ≤200 μs; ≤100 μs; ≤50 μs; ≤40 μs; ≤30 μs; ≤20 μs; and ≤10 μs. For example, the time x may be in the range of 10 μs to 50 ms.

The ion current transmitted by the mass filter may be larger after said step of changing the RF and/or DC voltage has begun than before changing the RF and/or DC voltage applied to said electrodes.

The detector may comprise a photomultiplier tube. However, other detectors are contemplated.

The method may comprise changing both the RF and DC voltage applied to said electrodes of the mass filter during said voltage transition period, and/or said further voltage transition period; wherein the DC voltage is varied over a first period of time within the voltage transition period and the RF voltage is varied over a second period of time within the voltage transition period; and wherein the first period of time is shorter than the second period of time, and/or the first period of time finishes before the second period of time finishes.

The length of time required to vary the RF voltage may be a limiting factor in the length of the voltage transition period. In order to reduce the length of the voltage transition period, the DC voltage may begin to be varied at the same time or later than the time at which the RF voltage starts to be varied, but with the variation in the DC voltage finishing at or before the variation in the RF voltage finishes.

Therefore, the step of changing the RF and/or DC voltage applied to said electrodes of the mass filter may comprise changing both the RF and DC voltages applied to said electrodes at each of one or more voltage transition periods, and the change in RF voltage may lag the change in the DC voltage. The step of changing the RF and/or DC voltage may decrease the mass to charge ratios of the ions that are able to be transmitted by the mass filter.

Alternatively, the step of changing the RF and/or DC voltage applied to said electrodes of the mass filter may comprise changing both the RF and DC voltages applied to said electrodes during each voltage transition period, and the change in DC voltage may lag the change in the RF voltage. The step of changing the RF and/or DC voltage may increase the mass to charge ratios of the ions that are able to be transmitted by the mass filter.

The present invention also provides a mass spectrometer set up and configured to perform any of the methods described herein.

Accordingly, the first aspect of the present invention provides a mass spectrometer comprising:

a mass filter comprising a plurality of electrodes;

RF and DC voltage supplies;

an ion detector;

an ion blocking device or deflecting device for blocking or deflecting ions; and a controller set up and configured to control the spectrometer to:

apply RF and DC voltages from the voltage supplies to the electrodes of the mass filter such that the mass filter is capable of substantially only transmitting ions having a selected mass to charge ratio, or a selected range of mass to charge ratios;

detect the ions transmitted by the mass filter with the detector;

change the RF and/or DC voltage applied to said electrodes during a voltage transition period so as to change said selected mass to charge ratio, or said selected range of mass to charge ratios that the mass filter is capable of transmitting;

activate said ion blocking device or deflecting device during the voltage transition period so as to prevent all ions reaching the detector; and then deactivate said ion blocking device or deflecting device after the voltage transition period so as to allow ions to be transmitted by the mass filter to the detector.

The spectrometer and controller may be set up and configured to perform an of the methods described herein.

For example, the mass filter may be a multipole mass filter comprising a multipole electrode rod set. The multipole mass filter may be a quadrupole mass filter comprising a quadrupole rod set. However, other multipoles are contemplated herein.

The controller may be set up and configured to control the spectrometer to measure the signal output from the detector during said voltage transition period to determine the baseline signal of the detector; measure the ion signal from the detector after the voltage transition period; and subtract said baseline signal from the measured ion signal.

The controller may be set up and configured to control the spectrometer to change the RF and/or DC voltage applied to said electrodes during a further voltage transition period so as to change said selected mass to charge ratio, or said selected range of mass to charge ratios, that the mass filter is capable of transmitting; prevent all ions from reaching the detector during the further voltage transition period; and allow ions to be transmitted by the mass filter to the detector after the further voltage transition period.

The controller may be set up and configured to control the spectrometer to measure the signal output from the detector during said further voltage transition period to determine an updated baseline signal for the detector; measure the ion signal from the detector after the further voltage transition period; and subtract said updated baseline signal from the measured ion signal.

The concept of using an ion blocking or deflecting potential (during the voltage transition period) that is controlled independently of the RF and DC voltages applied to the electrodes of the mass filter is believed to be novel and inventive in its own right. This prevents or mitigates at least some of problems identified herein such as damage to the detector, without the ion blocking or deflecting voltages being coupled to the electrodes of the mass filter or being restricted to being controlled by the voltages applied to the mass filter.

Accordingly, from a second aspect, the present invention provides a method of mass spectrometry comprising:

applying RF and DC voltages to electrodes of a mass filter such that the mass filter is capable of substantially only transmitting ions having a selected mass to charge ratio, or a selected range of mass to charge ratios;

detecting the ions transmitted by the mass filter with a detector;

changing the RF and/or DC voltage applied to said electrodes during a voltage transition period so as to change said selected mass to charge ratio, or said selected range of mass to charge ratios, that the mass filter is capable of transmitting;

preventing at least some ions from reaching the detector during the voltage transition period by applying one or more voltage to at least one electrode of an ion blocking or deflecting device so as to arrange an electrical potential barrier in the path of the ions so as to block their passage or so as to deflect the ions, wherein the one or more voltage is controlled independently of the RF and DC voltages applied to the electrodes of the mass filter; and allowing ions to be transmitted by the mass filter to the detector after the voltage transition period.

The second aspect of the invention may have any of the features described in relation to the first aspect of the invention, except that not necessarily all ions need be prevented from reaching the detector during the voltage transition period.

The second aspect of the invention also provides a mass spectrometer comprising:

a mass filter comprising a plurality of electrodes;

RF and DC voltage supplies;

an ion detector;

an ion blocking device or deflecting device for blocking or deflecting ions; and a controller set up and configured to control the spectrometer to:

apply RF and DC voltages from the voltage supplies to the electrodes of the mass filter such that the mass filter is capable of substantially only transmitting ions having a selected mass to charge ratio, or a selected range of mass to charge ratios;

detect the ions transmitted by the mass filter with the detector;

change the RF and/or DC voltage applied to said electrodes during a voltage transition period so as to change said selected mass to charge ratio, or said selected range of mass to charge ratios that the mass filter is capable of transmitting;

apply one or more voltage to at least one electrode of said ion blocking device or deflecting device during the voltage transition period so as to prevent at least some ions reaching the detector by arranging an electrical potential barrier in the path of the ions so as to block their passage or so as to deflect the ions, wherein the controller is set up and configured to control the one or more voltage independently of the RF and DC voltages applied to the electrodes of the mass filter; and then deactivate said ion blocking device or deflecting device after the voltage transition period so as to allow ions to be transmitted by the mass filter to the detector.

According to a third aspect, the present invention provides a method of mass spectrometry comprising:

applying RF and DC voltages to electrodes of a mass filter such that the mass filter is capable of substantially only transmitting ions having a selected mass to charge ratio, or a selected range of mass to charge ratios;

changing the RF and/or DC voltage applied to said electrodes at one or more voltage transition times so as to change said selected mass to charge ratio, or said selected range of mass to charge ratios;

detecting ions transmitted by the mass filter with a detector; and preventing at least some of the ions transmitted by the mass filter during said one or more transition times, and/or during a defined period of time after one or more of said one or more transition times, from reaching the detector or being detected at the detector.

Preventing ions from being detected whilst the RF and/or DC voltage applied to the electrodes is changed prevents large ion current pulses reaching the detector. This may prolong the lifetime of the detector, may avoid detector power supply surges and may reduce detector baseline shifts. For example, changing the voltages applied to the mass filter may cause a momentary reduction in the resolving power of the mass filter, which would result in a relatively large ion pulse reaching the detector if it were not for the step of preventing ions from being detected whilst the RF and/or DC voltage applied to the electrodes is changed.

The method may be used in SIR or MRM experiments, or when a quadrupole scan has completed and is then programmed to return (step) the voltages to start values. Accurate detector baseline measurements may be made between individual SIR or MRM experiments, channels or scans. Preventing at least some of the ions which would otherwise be transmitted by the mass filter from reaching the detector or being detected at the detector as the voltages are changed, between the different experiments, channels or scans, prevents large ion current pulses hitting the detector.

After each of said one or more transition times, and/or after each of said defined periods of time, all of the ions transmitted by the mass filter may be permitted to reach the detector again.

The mass filter may be a multipole mass filter comprising a multipole electrode rod set. The multipole mass filter may be a quadrupole mass filter comprising a quadrupole rod set. However, other multipoles are contemplated herein.

The step of preventing ions from reaching the detector or being detected at the detector may comprise blocking the ions or redirecting the flight path of the ions such that they do not reach the detector.

Said blocking may comprise temporarily applying a potential to an electrode so as to create a potential barrier that blocks the path of the ions to the detector. For example, the potential on an Einzel lens or other ion-optical element may be changed so as to form a potential barrier that blocks the ions.

The mass filter may be a multipole filter, or a multipole filter is provided upstream of said mass filter for transmitting ions into the mass filter, or a multipole filter is provided between said mass filter and said detector for transmitting ions from the mass filter to the detector; wherein RF and DC voltages are applied to said multipole filter in order to guide ions therethrough, and wherein said blocking comprises changing the DC voltage applied to the multipole filter such that ions cannot be transmitted through the multipole filter.

The blocking step may comprise temporarily increasing the DC voltage applied to said multipole filter so as to force all ions to become unstable in the multipole filter.

The mass filter may be said multipole filter, and said step of changing the RF and/or DC voltage applied to the mass filter may comprise changing both the RF and DC voltages applied to said electrodes at each of one or more voltage transition times in a manner whereby, for increasing RF changes, the DC voltage change leads the RF voltage change and for decreasing RF changes the DC voltage lags the RF voltage change, so as to result in said blocking step.

Ion gates may be used to block the ion path to the detector.

Said redirecting may comprise applying a voltage to an ion steering lens or ion deflector so as to divert the ions such that they do not reach the detector.

The step of changing the RF and/or DC voltage applied to said electrodes of the mass filter may comprise discontinuously stepping the value of the RF and/or DC voltage applied to said electrodes.

A first combination of RF and DC voltages may be applied to said electrodes for a first time period during which selected ions having a first mass to charge ratio or first range of mass to charge ratios are transmitted by the mass filter. The RF and/or DC voltage applied to said electrodes may then be changed at one of said voltage transition times, and a second combination of RF and DC voltages may then applied to said electrodes for a second time period during which selected ions having a second mass to charge ratio or second range of mass to charge ratios are transmitted by the mass filter.

The RF and/or DC voltage applied to said electrodes may be changed at any number of voltage transition times.

The step of preventing ions reaching the detector or being detected at the detector may be performed for different lengths of time at different voltage transition periods. For example, the length of time may vary as a function of the time that is expected for the RF and DC voltages to settle to the new values after they have been changed. Alternatively, or additionally, the length of time may vary depending on the direction that the RF and/or DC voltage is stepped (i.e. depending on whether the voltages are changed such that the mass to charge ratio enabled to be transmitted by the mass filter is increased or decreased).

The period during which ions are prevented from reaching the detector or being detected by the detector (e.g. said defined period) for each voltage change may be x, wherein x is selected from the group consisting of: ≥10 μs; ≥20 μs; ≥30 μs; ≥40 μs; ≥50 μs;≥100 μs; ≥200 μs; ≥300 μs; ≥400 μs; ≥500 μs; ≥600 μs; ≥700 μs; ≥800 μs; ≥900 μs; ≥1 ms; ≥5 ms; ≥10 ms; ≥15 ms; ≥20 ms; ≥25 ms; ≥30 ms; ≥35 ms; ≥40 ms; ≥45 ms; and ≥50 ms. Additionally, or alternatively, x may be selected from the group consisting of: ≤50 ms; ≤45 ms; ≤40 ms; ≤35 ms; ≤30 ms; ≤25 ms; ≤20 ms; ≤15 ms; ≤10 ms; ≤5 ms; ≤900 μs; ≤800 μs; ≤700 μs; ≤600 μs; ≤500 μs; ≤400 μs; ≤300 μs; ≤200 μs;≤100 μs; ≤50 μs; ≤40 μs; ≤30 μs; ≤20 μs; and ≤10 μs. For example, the time x may be in the range of 10 μs to 50 ms.

The ion current transmitted by the mass filter may be larger after said step of changing the RF and/or DC voltage than before changing the RF and/or DC voltage applied to said electrodes.

The detector may comprise a photomultiplier tube. However, other detectors are contemplated.

Said step of changing the RF and/or DC voltage applied to said electrodes of the mass filter may comprise changing both the RF and DC voltages applied to said electrodes at each of one or more voltage transition times, and wherein the change in DC voltage lags the change in the RF voltage.

The step of changing the RF and/or DC voltage may increase the mass to charge ratios of the ions that are able to be transmitted by the mass filter.

Said step of changing the RF and/or DC voltage applied to said electrodes of the mass filter may comprise changing both the RF and DC voltages applied to said electrodes at each of one or more voltage transition times, and wherein the change in RF voltage lags the change in the DC voltage.

The step of changing the RF and/or DC voltage may decrease the mass to charge ratios of the ions that are able to be transmitted by the mass filter.

The method may comprise measuring the baseline signal of the detector during said step of preventing ions from reaching the detector or being detected at the detector.

The third aspect of the present invention also provides a mass spectrometer configured to perform any of the methods described herein.

Accordingly. the third aspect of the present invention provides a mass spectrometer comprising:

a mass filter comprising a plurality of electrodes;

RF and DC voltage supplies;

an ion detector;

an ion blocking device or deflecting device for blocking or deflecting ions; and a controller configured to:

apply RF and DC voltages from the voltage supplies to the electrodes of the mass filter such that the mass filter is capable of substantially only transmitting ions having a selected mass to charge ratio, or a selected range of mass to charge ratios;

change the RF and/or DC voltage applied to said electrodes at one or more voltage transition times so as to change said selected mass to charge ratio, or said selected range of mass to charge ratios;

detect ions transmitted by the mass filter with the detector; and activate said ion blocking device or deflecting device so as to prevent at least some of the ions transmitted by the mass filter during said one or more transition times, and/or during a defined period of time after said one or more transition times, from reaching the detector or being detected at the detector.

The mass filter may be a multipole mass filter comprising a multipole electrode rod set. The multipole mass filter may be a quadrupole mass filter comprising a quadrupole rod set. However, other multipoles are contemplated herein.

The controller may changes the RF and/or DC voltage applied to said electrodes at one or more voltage transition times by discontinuously stepping the value of the RF and/or DC voltage applied to said electrodes.

The mass spectrometer described herein may comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The mass spectrometer may further comprise a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The mass spectrometer may comprise a chromatography or other separation device upstream of an ion source. The chromatography separation device may comprise a liquid chromatography or gas chromatography device. The separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

The analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

In order to effect Electron Transfer Dissociation optionally either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

In order to effect Electron Transfer Dissociation, optionally: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

The process of Electron Transfer Dissociation fragmentation may comprise interacting analyte ions with reagent ions, wherein the reagent ions comprise dicyanobenzene, 4-nitrotoluene or azulene.

BRIEF DESCRIPTION OF THE DRAWINGS

Various embodiments will now be described, by way of example only, and with reference to the accompanying drawings in which.

DETAILED DESCRIPTION

Figure 1:
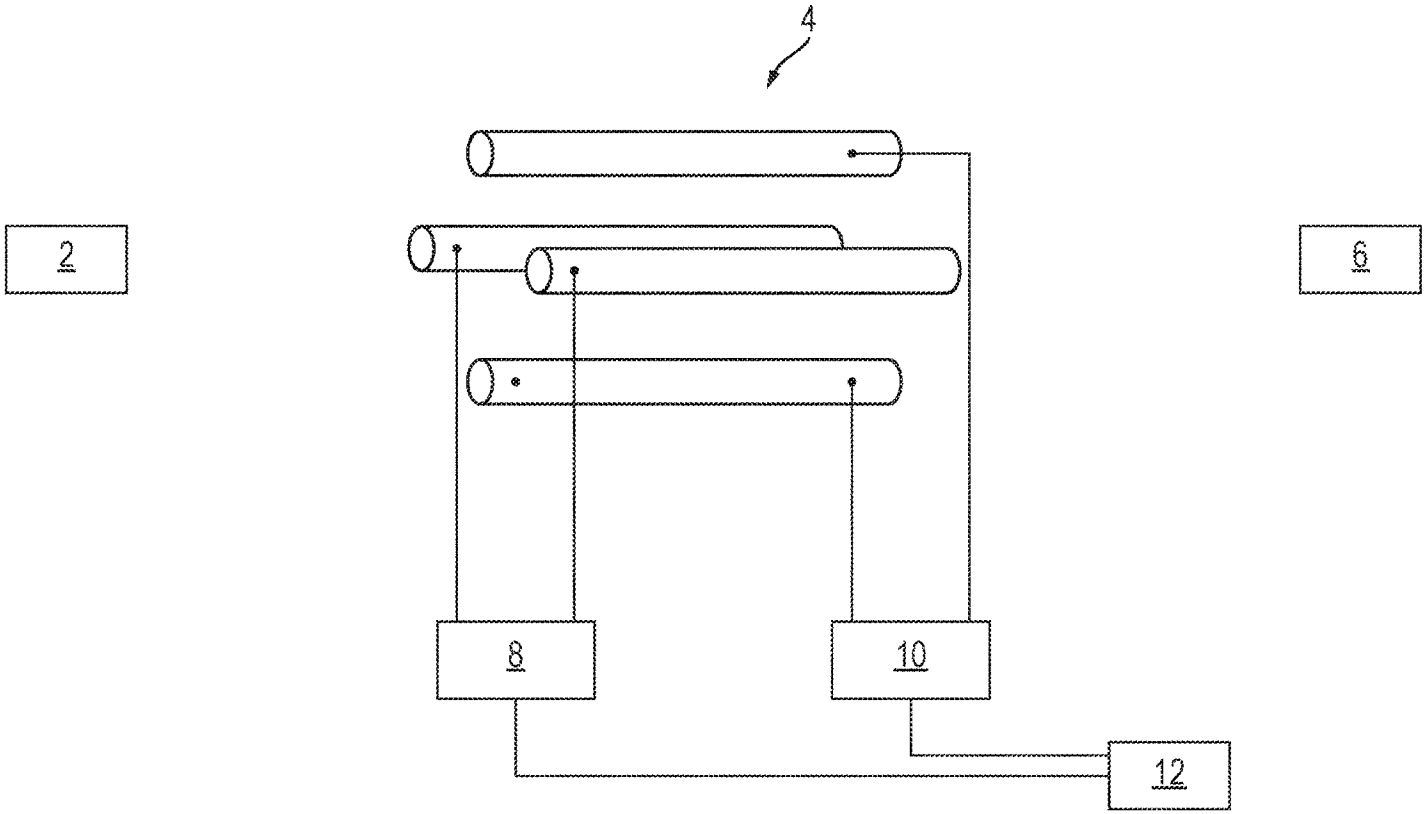
FIG. 1 shows a schematic of a conventional quadrupole mass analyser.

FIG. 1 shows a schematic of a prior art arrangement for analysing sample ions from a source of ions 2 using a quadrupole mass filter 4 and a downstream detector 6. Ions are transmitted from the source of ions 2 to the quadrupole mass filter 4. For example, the source of ions may be fragmentation or reaction cell and the ions transmitted to the quadrupole mass filter 4 may be fragment or product ions. RF and DC voltage supplies 8,10 apply RF and DC voltages to the electrodes of the quadrupole mass filter 4 in the known manner such that only ions having a certain mass to charge ratio, or a certain range of mass to charge ratios, are capable of being transmitted by the mass filter 4. If the detector 6 detects that ions have been transmitted by the mass filter 4 then it is known that the sample comprises ions having the mass to charge ratio(s) selected to be transmitted by the mass filter 4. A controller 12 controls the voltage supplies 8,10 such that the voltages applied to the mass filter 4 are scanned or stepped with time such that different mass to charge ratios, or different ranges of mass to charge ratios, are capable of being transmitted by the mass filter 4 at the different times. If the detector 6 detects ions at any of these different times then it is determined that the sample comprises ions having mass to charge ratios capable of being transmitted by the mass filter at these different times.

Alternatively, the source of ions 2 may be a source of precursor ions and the precursor ions may be fragmented or reacted in a fragmentation or reaction cell downstream of the quadrupole mass filter 4. For example, RF and DC voltage supplies 8,10 may apply RF and DC voltages to the electrodes of the quadrupole mass filter 4 in the known manner such that only precursor ions having a certain mass to charge ratio, or a certain range of mass to charge ratios, are capable of being transmitted by the mass filter 4. These transmitted precursor ions may then be fragmented or reacted in a fragmentation or reaction cell so as to generate fragment or product ions. These ions may then be detected by detector 6. For example, detector 6 may form part of a Time of Flight mass analyser that detects the mass to charge ratios of the fragment or product ions. The detected fragment or product ions are therefore able to be associated with their respective precursor ion, since it the mass to charge ratio(s) of the precursor ions transmitted by the mass filter 4 is known. The controller 12 then controls the voltage supplies 8,10 such that the voltages applied to the mass filter 4 are scanned or stepped with time such that different mass to charge ratios, or different ranges of mass to charge ratios, are capable of being transmitted by the mass filter 4 at the different times. At each of these different times, the precursor ions are fragmented or reacted and the resulting fragment or product ions detected and associated with their respective precursor ion.

It has been recognised that scanning or stepping the voltages applied to the quadrupole mass filter 4 may result in relatively large pulses of ions being transmitted by the mass filter 4, resulting in the detector baseline signal shifting and/or the power supply of the detector 6 being overloaded.

Figure 2A:
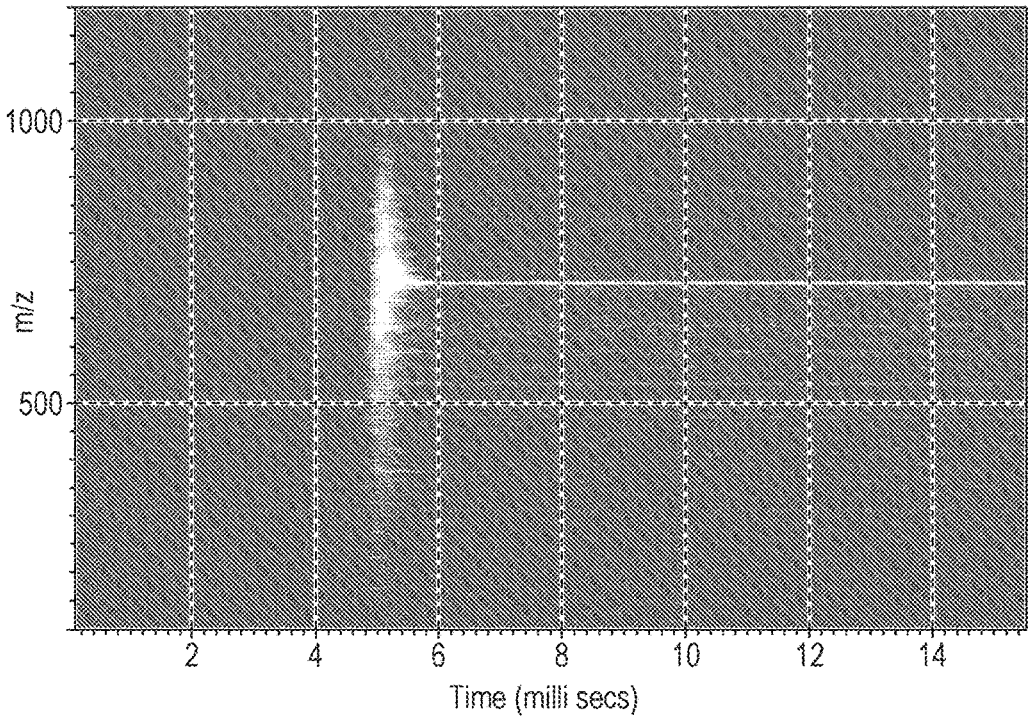
FIGS. 2A-2B show plots of how the ion signal detected from a quadrupole varies with time as the DC and RF voltages applied to the quadrupole are changed such that the mass to charge ratio of ions capable of being transmitted is increased, wherein the change in the DC voltage applied to the quadrupole lags the change in the RF voltage applied to the quadrupole.
Figure 2B:
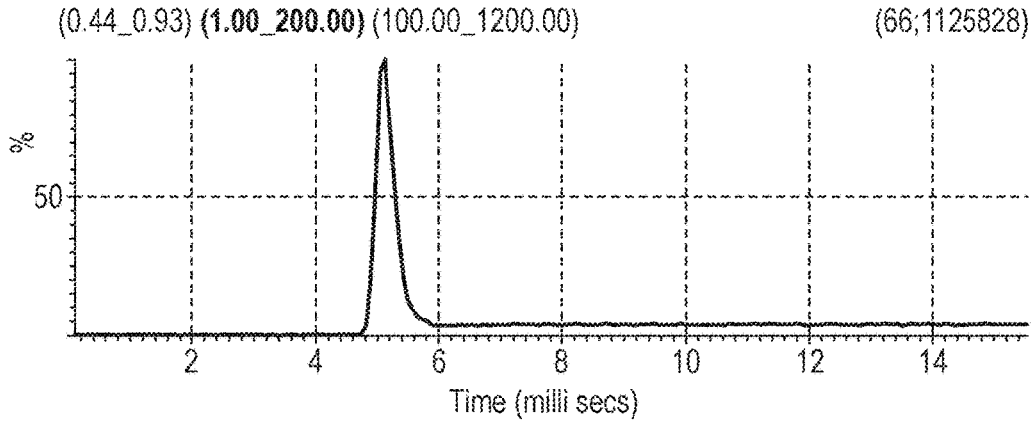

FIGS. 2A-2B shows plots of how an ion signal transmitted by the mass filter 4 of FIG. 1 and detected by detector 6 varies with time as the voltages applied to the mass filter 4 are changed such that the mass filter 4 changes from being capable of substantially only transmitting ions having a mass to charge ratio of 100 to being capable of substantially only transmitting ions having a mass to charge ratio of 710. The ion signal was detected with a Time of Flight mass analyser and the voltage driving circuits 8,10 were configured such that changes in the DC voltage lag changes in the RF voltage.

FIG. 2A shows the ion signal intensities detected as a function of mass to charge ratio and time. Initially, the quadrupole 4 is set so as to be capable of only transmitting ions having a mass to charge ratio of 100. At these times substantially no ions are detected at the detector 6. Between 4.5 ms and 6 ms, the voltages applied to the quadrupole 4 are changed in order to set the quadrupole 4 to be capable of transmitting only ions having a mass to charge ratio of 710. It can be seen from FIG. 2A that this results in ions of many different mass to charge ratios being detected by detector 6 at about the time that the voltages are changed, before the ion signal then stabilises with substantially only ions having a mass to charge ratio of 710 being detected. Weaker ion signals for ions of other masses are shown, resulting from fragmentation of the precursor ions transmitted by the quadrupole 4. This graph shows that changing the voltages applied to the quadrupole 4 for selectively transmitting ions having a different mass to charge ratio causes a temporarily loss of resolution of the quadrupole 4.

FIG. 2B shows the total ion signal intensity detected at the detector 6 as a function of time. It can be seen that substantially no ion signal is detected prior to changing the voltages applied to the quadrupole 4. When the voltages are changed, from 4.5 to 6 ms, the total ion signal rises significantly and peaks, prior to falling to a stable level. The peak in the total ion signal corresponds to the voltage transition period in which there is a temporary loss of resolution in the quadrupole 4. This may result in the detector 6 being overloaded or in detector baseline shifting, as described above. The total ion signal after the peak corresponds to the signal from substantially only ions having a mass to charge ratio of 710, i.e. when the quadrupole 4 has stabilised after the voltage transition period.

Figure 3A:
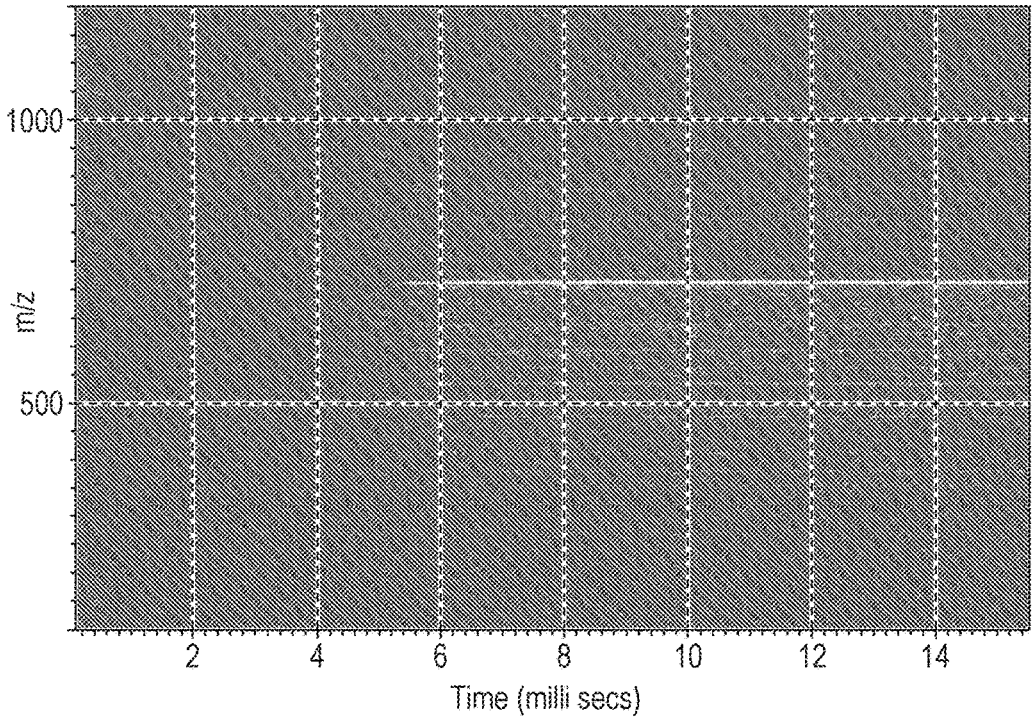
FIGS. 3A-3B shows plots of how the ion signal detected from the same quadrupole varies with time as the DC and RF voltages applied to the quadrupole are changed such that the mass to charge ratio of ions capable of being transmitted is reduced.
Figure 3B:
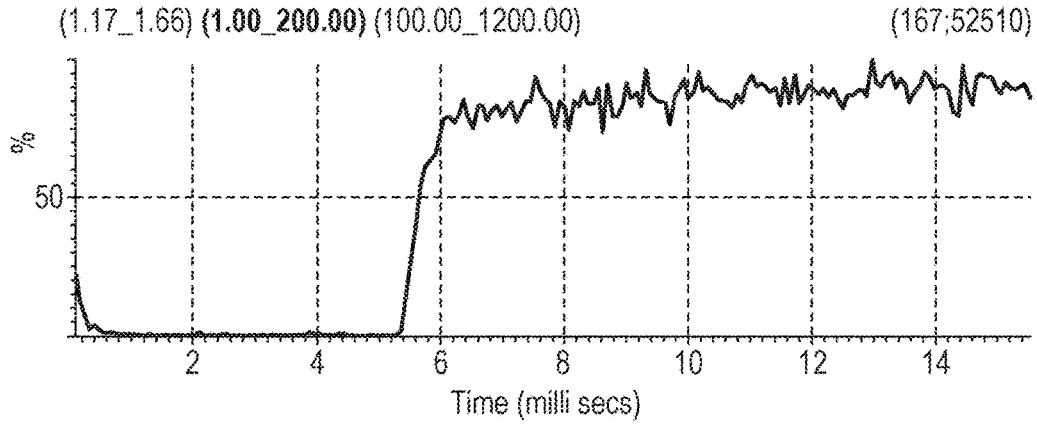

FIGS. 3A-3B show plots corresponding to those of FIGS. 2A-2B respectively, except wherein the voltages applied to the quadrupole 4 are changed such that the quadrupole 4 changes from being capable of substantially only transmitting ions having a mass to charge ratio of 1300 to being capable of substantially only transmitting ions having a mass to charge ratio of 710. FIG. 3A shows the ion signal intensities detected as a function of mass to charge ratio and time. Initially, the quadrupole 4 is set to be capable of only transmitting ions having a mass to charge ratio of 1300. At these times substantially no ions are detected at the detector 6. At a time of around 4.5 ms, the voltages applied to the quadrupole 4 are changed in order to set the quadrupole 4 to transmit only ions having a mass to charge ratio of 710. It can be seen from FIG. 3A that this results in substantially only ions having a mass to charge ratio of 710 being detected about the time that the voltages are changed. Weaker ion signals for ions of other masses are shown, resulting from fragmentation of the precursor ions transmitted by the quadrupole 4.

FIG. 3B shows the total ion signal intensity detected at the detector 6 as a function of time. It can be seen that substantially no ion signal is detected prior to changing the voltages applied to the quadrupole 4. When the voltages are changed, around 4.5 ms, the total ion signal rises to a higher substantially constant level (the fluctuations illustrated are due to the use of a scaling factor), without overshooting the new level. This shows that changing the voltages applied to the quadrupole 4 for selectively transmitting ions having a different mass to charge ratio does not cause a temporarily loss of resolution when stepping in the direction of high mass to charge ratio to low mass to charge ratio (when the change in DC voltage lags the change in the RF voltage).

In order to avoid the above-described problems occurring due to the temporary loss of resolution of the mass filter 4, the embodiments of the present invention block or divert the ion beam during at least a portion of the periods during which the voltages applied to the mass filter 4 are changed, e.g. during at least a portion of the inter-scan periods. This prevents high ion current spikes impacting on the detector 6 due to the temporary loss of resolution of the mass filter 4 that occurs whilst the voltages are changed, which may help preserve the detector baseline signal level and/or enables an acquisition system to measure any changes in the detector baseline signal level during the periods which the voltages applied to the mass filter 4 are changed. The newly measured detector baseline signal may then be subtracted from the ion signal obtained during the next acquisition period.

Figure 4:
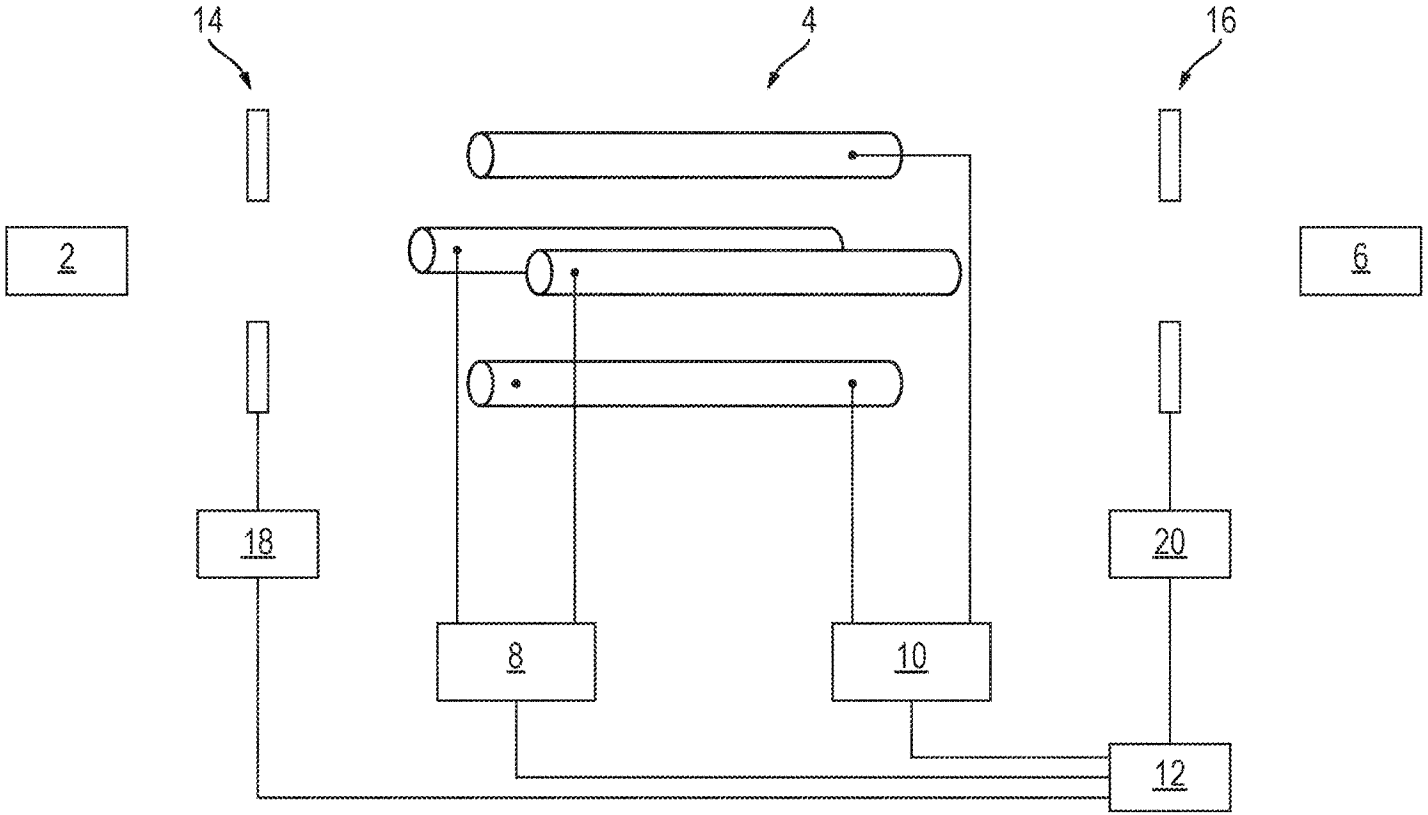
FIG. 4 shows a schematic of a quadrupole mass analyser according to an embodiment of the present invention.

FIG. 4 shows a schematic of an embodiment of the present invention. The instrument is substantially the same as that shown and described in relation to FIG. 1, except that the instrument also includes an ion blocking or deflecting device 14 arranged upstream of the mass filter 4. The upstream ion blocking or deflecting device 14 comprises one or more electrodes connected to a voltage supply 18, which is in turn electrically controlled by the controller 12. Additionally, or alternatively, to providing the upstream ion blocking or deflecting device 14 in the instrument, the instrument may include an ion blocking or deflecting device 16 arranged downstream of the mass filter 4. The downstream ion blocking or deflecting device 16 comprises one or more electrodes connected to a voltage supply 20, which is in turn electrically controlled by the controller 12.

In operation, the instrument may be used for analysing the mass to charge ratios of a sample of ions from the source of ions 2. For example, the source of ions 2 may be a fragmentation or reaction cell in which precursor ions are fragmented or reacted so as to produce fragment or product ions respectively. In this example it may then be desired to mass analyse such fragment or product ions. Ions are directed from the source of ions 2 towards the mass filter 4. If the upstream ion blocking or deflecting device 14 is present in the instrument, the controller 12 controls the voltage supply 18 such that the upstream ion blocking or deflecting device 14 is initially deactivated. For example, the controller 12 may control the voltage supply 18 such that no voltage, a ground voltage or a negligible voltage is applied to the ion blocking or deflecting device 14. In other words, the upstream ion blocking or deflecting device 14 allows substantially all ions to pass from the source of ions 2 to the mass filter 4.

The controller 12 controls the RF and DC voltage supplies 8,10 to apply RF and DC voltages to the electrodes of the mass filter 4 in the known manner such that only ions having a first mass to charge ratio, or a first range of mass to charge ratios, are capable of being transmitted by the mass filter 4. If ions having this first mass to charge ratio, or first range of mass to charge ratios, are present in the sample then these ions are transmitted by the mass filter 4.

If the downstream ion blocking or deflecting device 16 is present in the instrument, the controller 12 controls the voltage supply 20 such that the downstream ion blocking or deflecting device 16 is initially deactivated. For example, the controller 12 may control the voltage supply 20 such that substantially all ions transmitted by the mass filter 4 to pass to the detector 6 e.g. a voltage may be applied to the ion blocking or deflecting device 16 so as to attract the ions. If the detector 6 detects that ions have been transmitted to it by the mass filter 4, then it is determined that the sample comprises ions having the first mass to charge ratio, or first range of mass to charge ratios.

The controller 12 then controls the RF and DC voltage supplies 8,10 to change the RF and DC voltages applied to the electrodes of the mass filter 4, in the known manner, for the purpose of setting the mass filter 4 to be capable of transmitting only ions having a second mass to charge ratio, or a second range of mass to charge ratios. However, it is not possible for the control circuits of the RF and DC voltage supplies 8,10 to immediately step the RF and DC voltages applied to the electrodes to the new RF and DC voltage values. Rather, there is a voltage transition period during which the values of the RF and DC voltages progressively increase or decrease to their new values. As described above, this may cause a temporary loss of resolution of the mass filter 4, resulting in many ions being transmitted through the mass filter 4 to the detector 6. This may potentially cause a relatively long term shift in the baseline signal of the detector 6 and/or the power supply of the detector 6 being overloaded.

Embodiments of the invention overcome this problem by controlling the upstream ion blocking or deflecting device 14 and/or the downstream ion blocking or deflecting device 16 so as to prevent ions reaching the detector 6 during at least part of the voltage transition period in which the mass filter 4 loses resolution due to the change in RF and DC voltages applied to it. For example, if the upstream ion blocking or deflecting device 14 is present in the instrument, the controller 12 controls the voltage supply 18 so as to activate the upstream ion blocking or deflecting device 14 so as to prevent all ions passing from the source of ions 2 to the mass filter 4, e.g. by applying a voltage to the upstream ion blocking or deflecting device 14 so as to repel the ions. The controller 12 may activate the upstream ion blocking or deflecting device 14 when the voltage transition period begins, i.e. when the controller 12 sends a signal to the voltage supplies 8,10 to change the RF and DC voltages applied to the mass filter 4. Ions are then unable to enter the mass filter 4 and hence are unable to reach the detector 6. The controller 12 may subsequently deactivate the upstream ion blocking or deflecting device 14 when the voltage transition period ends, i.e. when the RF and DC voltages applied to the mass filter 4 have stabilised at their values for setting the mass filter 4 to be capable of transmitting only ions having a second mass to charge ratio, or a second range of mass to charge ratios. Once the upstream ion blocking or deflecting device 14 has been deactivated, ions are then able to enter the mass filter 4 and if any of these ions have the second mass to charge ratio, or are in the second range of mass to charge ratios, then these ions will be transmitted by the mass filter 4 to the detector 6.

If the downstream ion blocking or deflecting device 16 is present in the instrument, it may be used to prevent ions reaching the detector 6 during at least part of the voltage transition period in which the mass filter 4 loses resolution due to the change in RF and DC voltages applied to it. For example, the controller 12 may control the voltage supply 20 so as to activate the downstream ion blocking or deflecting device 16 so as to prevent all ions passing from the mass filter 4 to the detector 6. The controller 12 may activate the downstream ion blocking or deflecting device 16 when the voltage transition period begins, i.e. when the controller 12 sends a signal to the voltage supplies 8,10 to change the RF and DC voltages applied to the mass filter 4. Ions are then unable pass from the mass filter 4 to the detector 6. The controller 12 may subsequently deactivate the downstream ion blocking or deflecting device 16 when the voltage transition period ends, i.e. when the RF and DC voltages applied to the mass filter 4 have stabilised at their values for setting the mass filter 4 to be capable of transmitting only ions having a second mass to charge ratio, or a second range of mass to charge ratios. Once the downstream ion blocking or deflecting device 16 has been deactivated, ions are then able to be transmitted from the mass filter 4 to the detector 6.

The upstream ion blocking or deflecting device 14 and/or the downstream ion blocking or deflecting device 16 may block or deflect ions in a number of ways when activated. For example, the ion blocking or deflecting device 14,16 may comprise one or more electrode and the controller 12 may control its respective voltage supply 18,20 so as to apply a DC and/or RF voltage to the electrode so as to create an electrical potential barrier that blocks the passage of all ions in the downstream direction. When the ion blocking or deflecting device 14,16 is deactivated the controller 12 may control its respective voltage supply 18,20 so as to alter or remove the DC and/or RF voltage so that the potential barrier is removed, allowing the passage of ions downstream.

Alternatively, rather than blocking the passage of ions, the ion blocking or deflecting device 14,16 may deflect the flight paths of the ions. For example, the ion blocking or deflecting device 14,16 may comprise one or more electrode and the controller 12 may control its respective voltage supply 18,20 so as to apply a DC and/or RF voltage to the electrode so as to create an electrical potential profile than deflects the flight paths of all ions travelling in the downstream direction. For the upstream ion blocking or deflecting device 14, when activated, the device 14 deflects the flight paths of the ions such that no ions enter the mass filter 4 and hence no ions arrive at the detector 6. For the downstream ion blocking or deflecting device 16, when activated, the device 16 deflects the flight paths of the ions such that no ions reach the detector 6. In either case, when the ion blocking or deflecting device 14,16 is deactivated the controller 12 may control its respective voltage supply 18,20 so as to alter or remove the DC and/or RF voltage so that ions are not deflected in a manner than prevents them from entering the mass filter 4 or travelling from the mass filter 4 to the detector 6. For example, when activated, the ion blocking or deflecting device 14,16 may deflect all ions off axis or may defocus the ion beam.

The ion blocking or deflecting device 14,16 described herein may comprise an ion steering lens that diverts the ion beam when activated, an Einzel lens or other ion-optical element for blocking or deflecting the ions.

It is also contemplated that the ion blocking or deflecting device 14,16 may be an ion guide to which RF and/or DC voltages are applied in order to guide ions therethrough when operating in the deactivated mode, and to which RF and/or DC voltage are applied such that no ions are transmitted through the ion guide when operated in the activated mode.

Additionally, or alternatively, to providing said upstream and/or downstream ion blocking or deflecting device 14,16, an ion blocking voltage may be applied to one or more of the electrodes of the mass filter 4 during the voltage transition period so as to prevent all ions passing through the mass filter, or to render all ions unstable in the mass filter such that they do not reach the detector. For example, during the voltage transition period, if the RF voltage being applied to the mass filter is being increased, then the change in DC voltage may be controlled so as to lead the change in RF voltage. Alternatively, if the RF voltage being applied to the mass filter is being decreased during the voltage transition period, then the change in DC voltage may be controlled so as to lag the change in RF voltage.

It will therefore be appreciated that according to the embodiments of the invention, ions are transmitted towards the mass filter 4 and enter the mass filter 4. Only ions of a first mass to charge ratio, or first range of mass to charge ratios, are initially transmitted by the mass filter 4 to the detector 6, whereas other ions are filtered out by the mass filter 4. The RF and/or DC voltage applied to the electrodes of the mass filter 4 is then varied during the voltage transmission period so as to change the mass to charge ratio, or range of mass to charge ratios transmitted by the mass filter 4 at the end of the voltage transmission period. Substantially all ions maybe prevented from reaching the detector 6 during this voltage transition period. After the voltage transition period, ions of a second mass to charge ratio, or second range of mass to charge ratios, are transmitted by the mass filter 4 to the detector 6, whereas other ions are filtered out by the mass filter 4. The second mass to charge ratio, or second range of mass to charge ratios, is different to the first mass to charge ratio, or first range of mass to charge ratios.

Although only a single voltage transition period has been described above in detail, it is contemplated that the RF and/or DC voltage applied to the electrodes of the mass filter 4 may be changed during one or more further voltage transition periods so as to change said selected mass to charge ratio, or selected range of mass to charge ratios, that the mass filter 4 is capable of transmitting. For example, the voltage(s) may be changed in a second voltage transition period such that at the end of that period the mass filter 4 is only capable of transmitting a third mass to charge ratio, or third range of mass to charge ratios, whereas other ions are filtered out by the mass filter 4. The third mass to charge ratio, or third range of mass to charge ratios, may be different to the first and second mass to charge ratios, or first and second ranges of mass to charge ratios. Substantially all ions may be prevented from reaching the detector 6 during the second voltage transition period (e.g. using the ion blocking or deflecting device 14,16 described above), but may then subsequently be transmitted to the detector 6.

The method steps disclosed above and/or elsewhere herein may be performed in a single experimental run (e.g. on a single sample). For example, the method described herein may be used in SIR, SRM or MRM experiments, or the method may be applied to the step transition in voltages that occurs between mass scan functions.

As described above, preventing large quantities of ions reaching the detector 6 during the voltage transition period helps prevent the baseline level of the detector 6 from varying significantly and remaining elevated for long periods of time, e.g. several seconds after the high ion current has ceased. Furthermore, preventing substantially all of the ions reaching the detector 6 during the voltage transition period enables the baseline signal from the detector to be monitored during the voltage transition period. Since the ion current in the preceding acquisition may have been very high, once the ion current ceases, the detector baseline signal level may remain elevated for a long period of time. At the end of the voltage transition period ions may be transmitted from the mass filter 4 to the detector 6 and the ion signal at the detector 6 may be measured. As the baseline level is measured in the preceding voltage transition period, an up to date baseline level is able to be obtained and subtracted from the ion signal that is subsequently obtained from the detector. The baseline level may be monitored during a plurality, or all, of the voltage transition periods such that the baseline signal is repeatedly updated. The updated baseline signal is then able to be subtracted from the most recent ion signal, resulting in improved measurement accuracy of ion signals.

Although the present invention has been described with reference to preferred embodiments, it will be understood by those skilled in the art that various changes in form and detail may be made without departing from the scope of the invention as set forth in the accompanying claims.

Although embodiments have been described wherein a sample of fragment or product ions are mass selectively transmitted to a detector by the mass filter so as to determine which fragment or product ions are present in a sample, other experiments may be performed. For example, the mass filter may be controlled so as to be capable of mass selectively transmitting different precursor ions at different times so as to determine which precursor ions are present in a sample. Alternatively, the mass filter may be controlled so as to mass selectively transmit different precursor ions at different times, the precursor ions may be fragmented or reacted downstream to produce fragment or product ions, and the fragment or product ions may be detected by the detector. The fragment or product ions may then be correlated to their respective precursor ions, e.g. based on the time of detection of the fragment or product ions and the mass to charge ratio being transmitted by the mass filter at that time. The precursor ions may then be identified from their fragment ions.

The invention claimed is:

1. A method of mass spectrometry comprising:

applying RF and DC voltages to electrodes of a mass filter such that the mass filter is capable of substantially only transmitting ions having a selected mass to charge ratio, or a selected range of mass to charge ratios;

detecting the ions transmitted by the mass filter with a detector;

changing the RF and/or DC voltage applied to said electrodes during a voltage transition period so as to change said selected mass to charge ratio, or said selected range of mass to charge ratios, that the mass filter is capable of transmitting;

preventing all ions from reaching the detector during the voltage transition period;

measuring the signal output from the detector during said voltage transition period, when ions are prevented from reaching the detector, so as to determine a baseline signal of the detector;

allowing ions to be transmitted by the mass filter to the detector after the voltage transition period;

measuring the ion signal from the detector after the voltage transition period, when ions are allowed to be transmitted to the detector; and subtracting said baseline signal from the measured ion signal.

2. The method of claim 1, further comprising changing the RF and/or DC voltage applied to said electrodes during a further voltage transition period so as to change said selected mass to charge ratio, or said selected range of mass to charge ratios, that the mass filter is capable of transmitting;

preventing all ions from reaching the detector during the further voltage transition period; and allowing ions to be transmitted by the mass filter to the detector after the further voltage transition period.

3. The method of claim 2, comprising measuring the signal output from the detector during said further voltage transition period, when ions are prevented from reaching the detector, to determine an updated baseline signal for the detector;

measuring the ion signal from the detector after the further voltage transitional period, when ions are allowed to be transmitted to the detector; and subtracting said updated baseline signal from the measured ion signal.

4. The method of claim 1, wherein the mass filter is a multipole mass filter comprising a multipole electrode rod set.

5. The method of claim 1, wherein the step of preventing all ions from reaching the detector during the voltage transition period comprises:

preventing all ions entering the mass filter; and/or preventing all ions transmitted out of the mass filter from the reaching the detector.

6. The method of claim 1, wherein the step of preventing all ions from reaching the detector during the voltage transition period comprises:

applying one or more voltage to at least one electrode of an ion blocking or deflecting device so as to arrange an electrical potential barrier in the path of the ions or so as to deflect the ions such that the ions are prevented from reaching the detector.

7. The method of claim 6, wherein the voltage applied to the at least one electrode of an ion blocking or deflecting device is controlled independently of the RF and/or DC voltages applied to the electrodes of the mass filter.

8. The method of claim 1, comprising changing both the RF and DC voltage applied to said electrodes of the mass filter during said voltage transition period, and/or further voltage transition period; wherein the RF amplitude is increased during the voltage transition period; wherein, the DC voltage is varied over a first period of time within the voltage transition period and the RF voltage is varied over a second period of time within the voltage transition period; and wherein the first period of time is shorter than the second period of time, and/or the first period of time finishes before the second period of time finishes.

9. The method of claim 1, comprising changing both the RF and DC voltage applied to said electrodes of the mass filter during said voltage transition period, and/or said further voltage transition period; wherein, the RF amplitude is decreased during the voltage transition period; wherein, the RF voltage is varied over a first period of time within the voltage transition period and the DC voltage is varied over a second period of time within the voltage transition period; and wherein the first period of time is shorter than the second period of time, and/or the first period of time finishes before the second period of time finishes.

10. A mass spectrometer comprising:

a mass filter comprising a plurality of electrodes;

RF and DC voltage supplies;

an ion detector;

an ion blocking device or deflecting device for blocking or deflecting ions; and a controller set up and configured to control the spectrometer to:

apply RF and DC voltages from the voltage supplies to the electrodes of the mass filter such that the mass filter is capable of substantially only transmitting ions having a selected mass to charge ratio, or a selected range of mass to charge ratios;

detect the ions transmitted by the mass filter with the detector;

change the RF and/or DC voltage applied to said electrodes during a voltage transition period so as to change said selected mass to charge ratio, or said selected range of mass to charge ratios that the mass filter is capable of transmitting;

activate said ion blocking device or deflecting device during the voltage transition period so as to prevent all ions reaching the detector;

control the spectrometer to measure the signal output from the detector during said voltage transition period to determine a baseline signal of the detector;

deactivate said ion blocking device or deflecting device after the voltage transition period so as to allow ions to be transmitted by the mass filter to the detector;

measure the ion signal from the detector after the voltage transition period; and subtract said baseline signal from the measured ion signal.

* * * * *